US007942711B1

(12) United States Patent
Swan

(10) Patent No.: US 7,942,711 B1
(45) Date of Patent: May 17, 2011

(54) METHOD FOR CONTROLLING A MARINE PROPULSION TRIM SYSTEM

(75) Inventor: Allen F. Swan, Beaver Dam, WI (US)

(73) Assignee: Brunswick Corporation, Lake Forest, IL (US)

( * ) Notice: Subject to any disclaimer, the term of this patent is extended or adjusted under 35 U.S.C. 154(b) by 480 days.

(21) Appl. No.: 11/971,280

(22) Filed: Jan. 9, 2008

(51) Int. Cl.
*B63H 5/125* (2006.01)

(52) U.S. Cl. ..... 440/61 D; 440/61 G

(58) Field of Classification Search ..... 440/61 D, 440/61 G, 61 R, 56, 61 H, 61 J
See application file for complete search history.

(56) References Cited

U.S. PATENT DOCUMENTS

| | | | | | |
|---|---|---|---|---|---|
| 3,754,394 | A | | 8/1973 | Morrison | |
| 3,799,104 | A | * | 3/1974 | Kurling | 440/56 |
| 3,999,502 | A | | 12/1976 | Mayer | |
| 4,050,359 | A | | 9/1977 | Mayer | |
| 4,064,824 | A | * | 12/1977 | Hall et al. | 440/61 R |
| 4,096,820 | A | * | 6/1978 | Hall | 440/56 |
| 4,363,629 | A | | 12/1982 | Hall et al. | |
| 4,391,592 | A | | 7/1983 | Hundertmark | |
| 4,395,239 | A | * | 7/1983 | Hall et al. | 440/61 R |
| 4,449,365 | A | | 5/1984 | Hancock | |
| 4,631,035 | A | * | 12/1986 | Nakahama | 440/61 R |
| 4,929,202 | A | | 5/1990 | Tengelitsch | |
| 5,447,027 | A | | 9/1995 | Ishikawa et al. | |
| 5,720,637 | A | * | 2/1998 | Nakamura | 440/61 R |
| 5,969,302 | A | | 10/1999 | Nishizawa et al. | |
| 6,048,234 | A | * | 4/2000 | Uematsu et al. | 440/61 G |
| 6,165,032 | A | | 12/2000 | Nakamura | |
| 6,439,102 | B1 | | 8/2002 | Matsuzaki et al. | |
| 6,945,335 | B2 | | 9/2005 | Suzuki et al. | |

* cited by examiner

*Primary Examiner* — Lars A Olson
(74) *Attorney, Agent, or Firm* — William D. Lanyi

(57) ABSTRACT

A method is provided for controlling a marine propulsion trim system under two distinct modes of operation. A first mode operates hydraulic cylinders at a slower speed when the associated marine vessel is being operated at a speed above a predetermined threshold. For example, when the marine propulsion device is under load, such as when the marine vessel is operating on plane, the first mode of operation is used and the trim/tilt cylinders are operated at a slower speed. A second mode of operation is used when the marine propulsion system is being operated below a predetermined threshold. In other words, if the marine vessel is operating at a slow speed, the faster mode of operation is used. Similarly, if the marine vessel is being prepared for transport on a trailer, the very slow or non-existent speed of operation of the engine is used as an indicator which causes the second mode of operation to be employed.

17 Claims, 5 Drawing Sheets

METHOD FOR CONTROLLING A MARINE PROPULSION TRIM SYSTEM

BACKGROUND OF THE INVENTION

1. Field of the Invention

The present invention relates generally to a trim system of a marine propulsion device and, more particularly, to a method for causing an actuator of the trim system to move at a selected one of two actuation speeds, depending on conditions.

2. Description of the Related Art

Those skilled in the art of marine propulsion systems are aware of many different types of trim and tilt systems. Typically, trim and/or tilt systems incorporate a hydraulic cylinder connected between the transom of a marine vessel and a marine propulsion device, such as an outboard motor or a sterndrive unit.

U.S. Pat. No. 3,754,394, which issued to Morrison on Aug. 28, 1973, describes a hydraulic control system for an electric lift truck. It includes hydraulically powered mast tilting cylinders and fork hoist cylinders supplied with pressure fluid from an electric motor driven small and large capacity pair of pumps. The hydraulic circuit supplying pressure fluid to the cylinders includes a pair of spool-type metering valves, one for the tilt cylinders and one for the hoist cylinder. The hoist spool is a three-position spool having a neutral position, a lowering position and a hoisting position range. When the spool is stroked through the hoist range from low to high, fluid is metered by the spool to the hoist cylinder first at a small flow rate and gradually at increasing rates only from the small pump until the maximum flow capacity of the small pump is reached. Thereafter, as stroking continues, flow from the large pump is added gradually and progressively to the maximum flow of the small pump until the full flow capacities of both pumps is utilized to extend the hoist cylinder.

U.S. Pat. No. 3,999,502, which issued to Mayer on Dec. 28, 1976, discloses a hydraulic power trim and power tilt system supply. A hydraulic system for a combined power trim and shock absorbing piston cylinder unit of an outboard motor includes a reversible pump having a trim-up port connected by a pressure responsive pilot valve piston cylinder unit and a trim-down port through a reverse lock solenoid valve and a down-pilot spool valve providing full drain flow for trim-up and power flow for trim-down.

U.S. Pat. No. 4,050,359, which issued to Mayer on Sep. 27, 1977, discloses a hydraulic power trim and power tilt system supply. A hydraulic system for a combined power trim and shock absorbing piston cylinder unit of an outboard motor includes a reversible pump having a trim-up port connected by a pressure responsive pilot valve piston cylinder unit and a trim-down port through a reverse lock solenoid valve and a down-pilot spool valve providing full drain flow for trim-up and power flow for trim-down.

U.S. Pat. No. 4,363,629, which issued to Hall et al. on Dec. 14, 1982, describes a hydraulic system for an outboard motor with sequentially operating tilt and trim means. The device comprises a transom bracket adapted to be connected to a boat transom, a first pivot connecting a stem bracket to the transom bracket for pivotal movement of the stem bracket relative to the transom bracket about a first pivot axis which is horizontal when the transom bracket is boat mounted, a second pivot connecting a swivel bracket to the stem bracket below the first pivot for pivotal movement of the swivel bracket with the stem bracket and relative to the stem bracket about a second pivot axis parallel to the first pivot axis. A king pin pivotally connecting a propulsion unit including a rotatably mounted propeller to the swivel bracket for steering movement of the propulsion unit relative to the swivel bracket about a generally vertical axis and for common pivotal movement with the swivel bracket in a vertical plane about the first and second horizontal axes, a trim cylinder piston assembly pivotally connected to the stem bracket and to the swivel bracket, a tilt cylinder piston assembly pivotally connected to the transom bracket and to the stem bracket and a fluid conduit system communicating between a source of pressure fluid and each of the tilt cylinder piston assembly and the trim cylinder piston assembly and including apparatus operable, during reverse operation of the propulsion unit, for causing initial full extension to the trim cylinder piston assembly, followed by extension of the tilt cylinder piston assembly and for causing initial full contraction of the tilt cylinder piston assembly, followed by subsequent contraction of the trim cylinder piston assembly.

U.S. Pat. No. 4,391,592, which issued to Hundertmark on Jul. 5, 1983, discloses a hydraulic trim-tilt system. It includes a hydraulic trim-tilt piston-cylinder unit pivotally connected to both the transom bracket and the swivel bracket. Hydraulic trim piston-cylinder units are mounted in the transom bracket. A pilot operated check valve mounted in the piston of one of the trim piston-cylinder units serves to limit the maximum pressure in the system when the trim piston-cylinder units have reached the end of their stroke.

U.S. Pat. No. 4,449,365, which issued to Hancock on May 22, 1984, describes a lift, tilt and steering control for a lift truck. It includes a pair of separately controlled pumps. One pump supplies pressure fluid to a valve for a steering cylinder by way of a high priority port of a priority valve with the low priority flow passing to parallel connected lift and tilt valves which control operation of the lift cylinder and tilt cylinders, respectively. The capacity of a pump is sufficient to provide proper, effective operation of the steering and tilt functions but is not adequate to provide hydraulic fluid flow for high speed expansion of the lift cylinder. The other pump is operated to supply additional pressure fluid flow for high speed lift only when the lift valve is shifted to a raise position.

U.S. Pat. No. 4,631,035, which issued to Nakahama on Dec. 23, 1986, describes a hydraulic tilt device for a marine propulsion unit. The device employs a reversible fluid pump that drives a double acting cylinder to effect pivotal movement of the outboard drive between a tilted up and a tilted down position. The circuitry of the connection between the fluid pump and motor is such that the displaced fluid from the fluid motor need not flow through the pump during tilt down operation so that tilt down operation can be accomplished at a greater rate of speed than tilt up operation.

U.S. Pat. No. 4,929,202, which issued to Tengelitsch on May 29, 1990, describes a power trim cylinder protective locking device for an inboard/outboard boat motor. The support device maintains an outboard unit of a boat engine in a tilted position for travel. The outboard unit has a stationary driveshaft housing attached to the boat transom and a movable propeller drive unit pivotally attached with respect to the stationary drive shaft housing. A trim mechanism includes a cylinder, a hydraulically operated piston and an actuator rod engaged between the movable propeller drive unit and the stationary drive shaft housing for tilting the movable propeller drive unit to a desired angle between a lowered position and a raised position. The support device has an elongated rigid casing with a radial slot extending along the entire longitudinal length of the casing and a semi-rigid lining disposed within the casing forming a longitudinal aperture communicating with a radial slot through the casing.

U.S. Pat. No. 5,447,027, which issued to Ishikawa et al. on Sep. 5, 1995, describes a hydraulic drive system for hydraulic working machines. It includes a controller and several condition sensors. A boom-up target flow rate setting section determines a boom-up target flow rate based on signals from a pressure sensor and a rotational speed meter, a pump delivery rate detecting section determines a pump delivery rate based on signals from a tilt angle sensor and the rotational speed meter, a differential pressure detecting section and a center bypass flow rate calculating section determines a center bypass flow rate based on signals from pressure sensors, a boom cylinder calculating section determines a boom cylinder flow rate from the pump delivery rate and the center bypass flow rate, and a first pump target displacement volume calculating section calculates a first pump target tilt angle in accordance with a difference between the boom-up to target flow rate and the boom cylinder flow rate.

U.S. Pat. No. 5,969,302, which issued to Nishizawa et al. on Oct. 19, 1999, describes a lift control mechanism and method. A lift attached to a truck has a tailgate supported by at least one hydraulic lift and at least one tilt cylinder for respectively lifting the tailgate as a whole and rotating it for opening and closing. A control system for moving such a tailgate up and down as a whole and rotating it to open and close it is provided with a power unit including a hydraulic pump, an electric motor for the hydraulic pump, and a plurality of valves for selectively allowing or not allowing transport of a hydraulic liquid by the hydraulic pump into the hydraulic cylinders, a sensor for measuring the pressure inside the hydraulic pump, external switches, and a controller which includes a CPU, a timer and a semi-conductor switch and serves to calculate on real time the speed of the tailgate from signals from the sensor and the timer.

U.S. Pat. No. 6,165,032, which issued to Nakamura on Dec. 26, 2000, describes a tilt cylinder device for an outboard motor. A piston having its piston rod is extended to an outboard motor side and a free piston is freely movably inserted into a cylinder. Within the cylinder are oil chambers. An accumulator chamber is provided so as to surround the cylinder. A third communication passage is formed from the piston to the free piston.

U.S. Pat. No. 6,439,102, which issued to Matsuzaki et al. on Aug. 27, 2002, describes a tilt control device for a forklift truck. It comprises a tilt spool for operating the tilt cylinder, a pilot operation type flow rate control valve connected to the hydraulic pump via the tilt spool and adapted to be switched between a fully opened position and a half opened position which are different in opening from each other in response to addition/deletion of a pilot pressure, a pilot operation type logic valve disposed between the rod side oil compartment of the tilt cylinder and the flow rate control valve and adapted to permit hydraulic oil to flow into the rod side oil compartment and to be operated so as to open/close relative to hydraulic oil flowing out of the rod side oil compartment in response to the addition/deletion of the pilot pressure, and an electromagnetic switching valve for controlling the addition/deletion of the pilot pressure to the flow rate control valve and the logic valve.

U.S. Pat. No. 6,945,335, which issued to Suzuki et al. on Sep. 20, 2005, describes an oil pressure controlling device for an earth moving machine. An optimal pump flow for both dual tilt operations and single tilt operations is obtained at low cost without increasing the complexity of the device constitution. Where there is a wish to implement a dual tilt operation, a switch is selectively operated and, in accordance with this selection result, the differential pressure set value decreases and a comparatively small flow is supplied from the hydraulic pump to the left and right tilt cylinders. Accordingly, the extension/retraction speed of the left and right tilt cylinders decreases. Where there is a wish to implement a single tilt operation, a switch is selectively operated and, in accordance with this selection result, the differential pressure set value increases and a comparatively large flow is supplied from the hydraulic pump to the left cylinder. Accordingly, the extension/retraction speed of the left tilt cylinder increases. In this way, the tilt operating speed of the blade in dual tilt operations is made to be the same as the tilt operating speed of the blade in single tilt operations.

The patents described above are hereby expressly incorporated by reference in the description of the present invention.

In typical marine operations, a marine propulsion device is subject to a trim operation in which its angle is changed relative to the transom of a marine vessel. The trim operation is performed in order to advantageously affect the operation of a marine vessel. Beyond a certain angular relationship, between the marine propulsion device and the transom, the marine propulsion device can further be tilted in order to raise it out of the water or, during transport, to raise the marine propulsion device to a position that can more easily and reliably be supported when the marine vessel is transported on a trailer. Marine propulsion devices, particularly when used in saltwater environments, are typically tilted upward to remove them from the saltwater when the marine vessel is not in use. This operation typically uses the tilt capabilities of a hydraulic system that extends beyond the range of angular positions of the marine propulsion device assumed during trimming operations.

During tilting procedures, or trimming procedures when the marine vessel is generally stationary or operating below a threshold velocity, it is desirable to move the marine propulsion device as quickly as is practical. On the other hand, when the marine propulsion device is operating under load and the associated marine vessel is moving at a speed greater than a threshold speed, it is preferred that the trimming operation be accomplished at a lesser rate of speed. It would therefore be significantly beneficial if a relatively simple and inexpensive system could be provided which allows two different rates of actuation of the hydraulic trim/tilt system.

SUMMARY OF THE INVENTION

A method for controlling a marine propulsion trim system, in accordance with a preferred embodiment of the present invention, comprises the steps of providing the pump, providing a hydraulic cylinder, providing a piston disposed within the cylinder, providing an actuator shaft attached to the piston, connecting a first conduit in fluid communication between an outlet of the pump and a first cavity of the cylinder, connecting a second conduit in fluid communication between the second cavity of the cylinder and an oil return line to the pump, connecting a third conduit in fluid communication between the first and second cavities, receiving a first signal which represents a change from a first mode of operation to a second mode of operation, inhibiting a flow through the second conduit in response to the first signal, and permitting a flow through the third conduit in response to the first signal. The second mode of operation in a preferred embodiment of the present invention represents a faster speed of movement of the actuator shaft than the first mode of operation.

In a particularly preferred embodiment of the present invention, it further comprises the steps of receiving a second signal which represents a change from the second mode of operation to the first mode of operation, inhibiting flow through the third conduit in response to the second signal, and permitting a flow through the second conduit in response to the second signal.

In a preferred embodiment of the present invention, oil flows from the second cavity of the hydraulic cylinder and from the pump into the first cavity of the hydraulic cylinder when the marine propulsion trim system is in the second mode of operation. In a preferred embodiment of the present invention, the pump is a fixed displacement pump. The method of the present invention can further comprise the step of connecting the cylinder between a transom of a marine vessel and an outboard motor.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
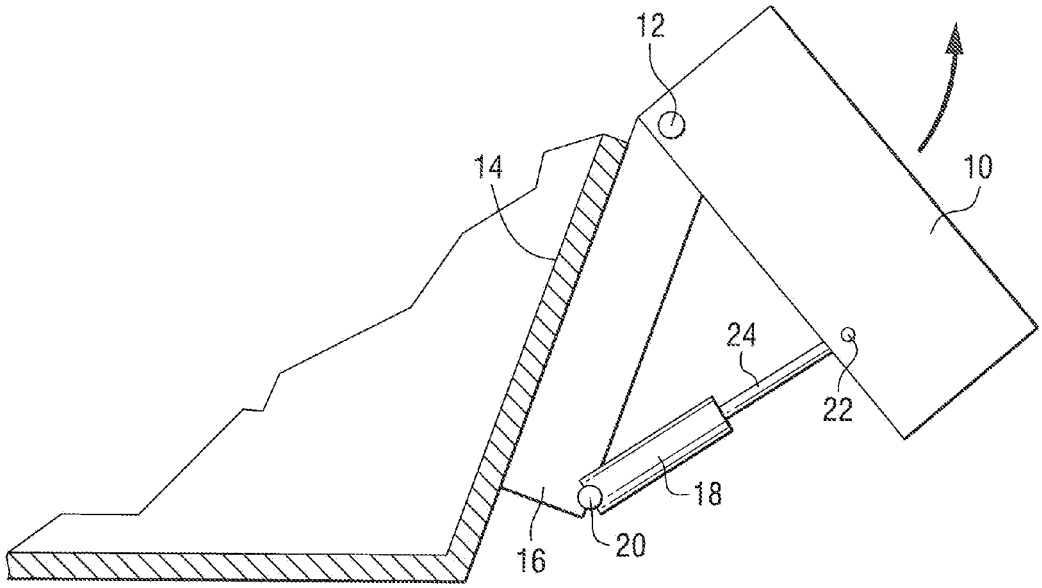
FIG. 1 is a highly simplified representation of a marine propulsion device associated with a cylinder which causes it to trim or tilt relative to the transom of the marine vessel.

Throughout the description of the preferred embodiment of the present invention, like components will be identified by like reference numerals.

FIG. 1 is a highly simplified schematic representation of an arrangement which shows how an outboard motor is supported for rotation, about a trim/tilt axis 12, relative to a transom 14 of a marine vessel. Also shown in FIG. 1 is a simplified transom bracket 16 which is schematically shown attached to the transom 14. The transom bracket 16 pivotally supports the outboard motor 10, or an alternative marine propulsion device, and a hydraulic cylinder 18 is connected between a first pivot axis 20 on the transom bracket 16 and a pivot axis 22 on the outboard motor 10. Extension of an actuator shaft 24 from the hydraulic cylinder 18 causes the marine propulsion device 10 to rotate about axis 12, as represented by the arrow in FIG. 1. It should be understood that FIG. 1 is highly schematic and provided simply for the purpose of showing the physical relationship between a hydraulic cylinder 18, its actuator shaft 24, a bracket 16 attached to a transom 14, and a pivot axis 22 of a marine propulsion device 10. Many different types and variations of the arrangement shown in FIG. 1 are well known to those skilled in the art of marine propulsion systems. Hydraulic components used to trim and tilt marine propulsion devices are described in greater detail in U.S. Pat. Nos. 3,999,502 and 4,363,629, which are described above. In addition, U.S. Pat. Nos. 4,391,592 and 4,631,035, which are also described above, illustrate alternative systems used to trim and tilt a marine propulsion device relative to the transom of a marine vessel.

As described in the patents identified above, hydraulic trim and tilt systems for marine propulsion devices incorporate a hydraulic pump which provides pressurized hydraulic fluid to a hydraulic cylinder with an actuator that is operated by a piston contained within the hydraulic cylinder. These types of systems are well known to those skilled in the art of marine propulsion devices and are generally used to cause the rotation of a marine propulsion device through a range of trim angles and also through a range of tilt angles. Typically, the term "trim" is used to describe the selection of an angle of a marine propulsion device during the operation of the marine propulsion device in order to advantageously affect the operation of a marine vessel. The trim is changed during operation, in a typical application, in order to affect the angle of the marine vessel on the water. The term "tilt" is commonly used to refer to the operation of changing the angle of the marine propulsion device relative to the marine vessel beyond the typical trim angles in order to lift the marine propulsion device out of the water. This is typically done to raise the marine propulsion device out of saltwater when the marine vessel is not in use and to raise the position of the marine propulsion device for transport on a boat trailer.

It would be advantageous if an inexpensive, but efficient, way could be provided to change the speed of operation of the cylinder between a relatively slow speed and a faster speed. For example, when operating to trim the marine propulsion device when the marine propulsion device is under a load, such as when an outboard motor is propelling a vessel up to or beyond its planing speed, it is generally advantageous to operate the hydraulic cylinder of the trim/tilt system at a relatively slow speed. However, when the marine vessel is operating below a preselected speed threshold or the vessel is stationary and the operator intends to tilt the outboard motor up to its maximum position, it is beneficial if the hydraulic actuators of the trim/tilt system can operate at a higher speed. It is beneficial if this selection of a slower speed or a higher speed can be made inexpensively and without the need for expensive components, such as extra pumps or a pump that is larger than necessary to perform the basic functions of the trim/tilt system.

Figure 2:
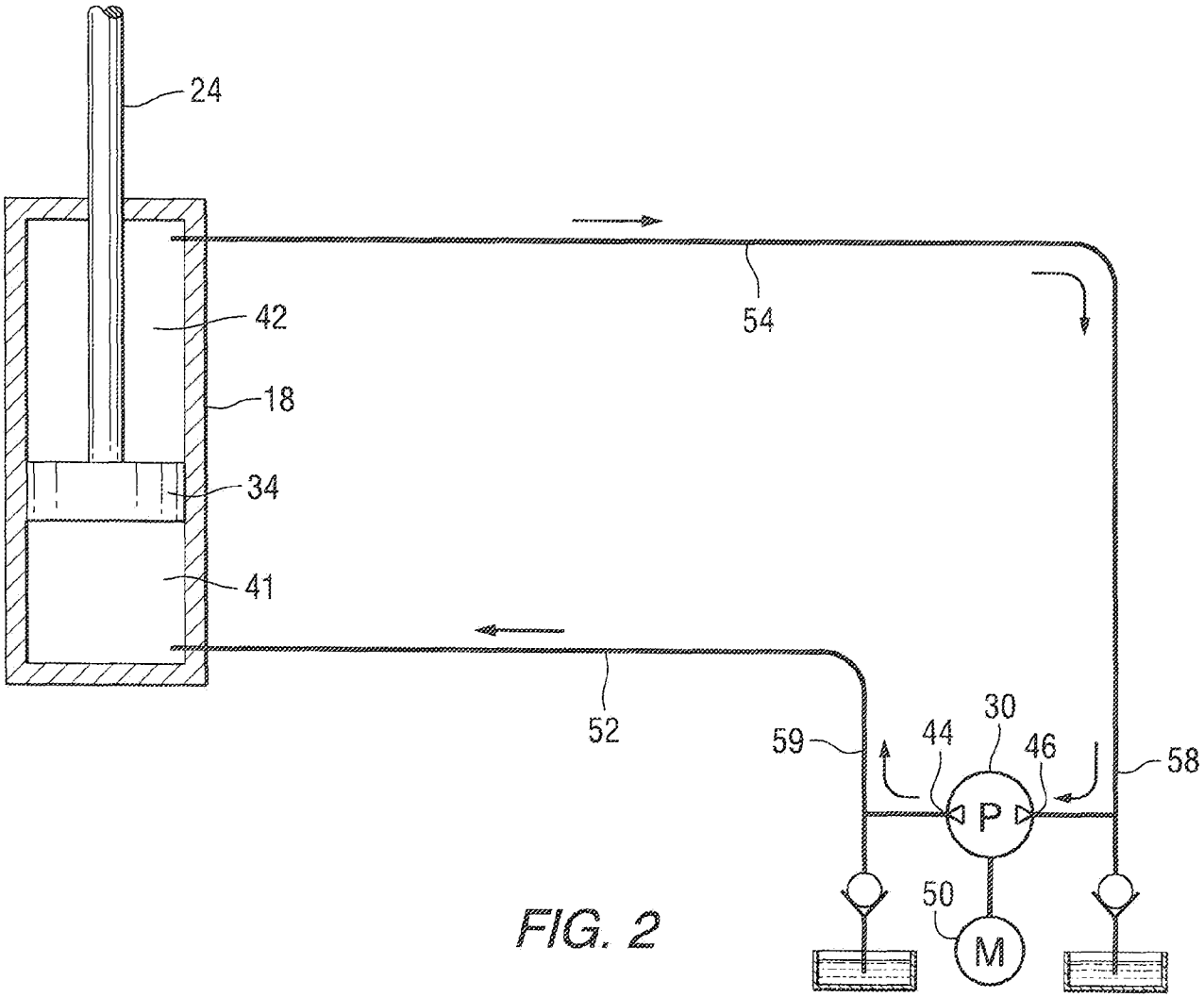
FIG. 2 shows a marine propulsion trim system in a simplified schematic illustration.

FIG. 2 is a schematic representation of a hydraulic cylinder 18 and a pump 30 which is configured to provide pressurized oil to the cylinder 18. A piston 34 is disposed within the cylinder 18. The piston 34 divides the internal volume of the cylinder 18 into first 41 and second 42 cavities. An actuator shaft 24 is attached to the piston 34 and extends through the second cavity 42 as shown. An outlet 44 of the pump 30 is connected in fluid communication with the first cavity 41 as shown in FIG. 2. It should be understood that the system can also be operated in a reverse manner, to cause the piston 34 and its actuator shaft 24 to retract into the cylinder 18. That operation would use the outlet 46 of the pump 30 instead of outlet 44. However, for the purpose of describing a preferred embodiment of the present invention, this operation will be described in terms of extending the actuator shaft 24 from the cylinder 18 (in an upward direction in FIG. 2).

The pump 30 is driven by a motor 50. Pressurized oil flows from the pump outlet 44, as represented by the arrows, and into the first cavity 41. This causes the piston 34 to move upward in FIG. 2. Oil from the second cavity 42 is forced through conduit 54 and through conduit 58 which operates as a return line to the pump 30. Check valves and reservoirs are illustrated in FIG. 2 to represent the fact that additional oil is stored in association with the pump 30 and used when additional oil is required for the system.

It should be understood that the system illustrated in FIG. 2 is a normal arrangement that allows the pump 30 to cause the piston 34 and its actuator shaft 24 to move and extend the shaft 24 from the cylinder 18. The speed of movement of the piston 34 is determined by the rate of flow of hydraulic fluid from the pump 30.

Figure 3:
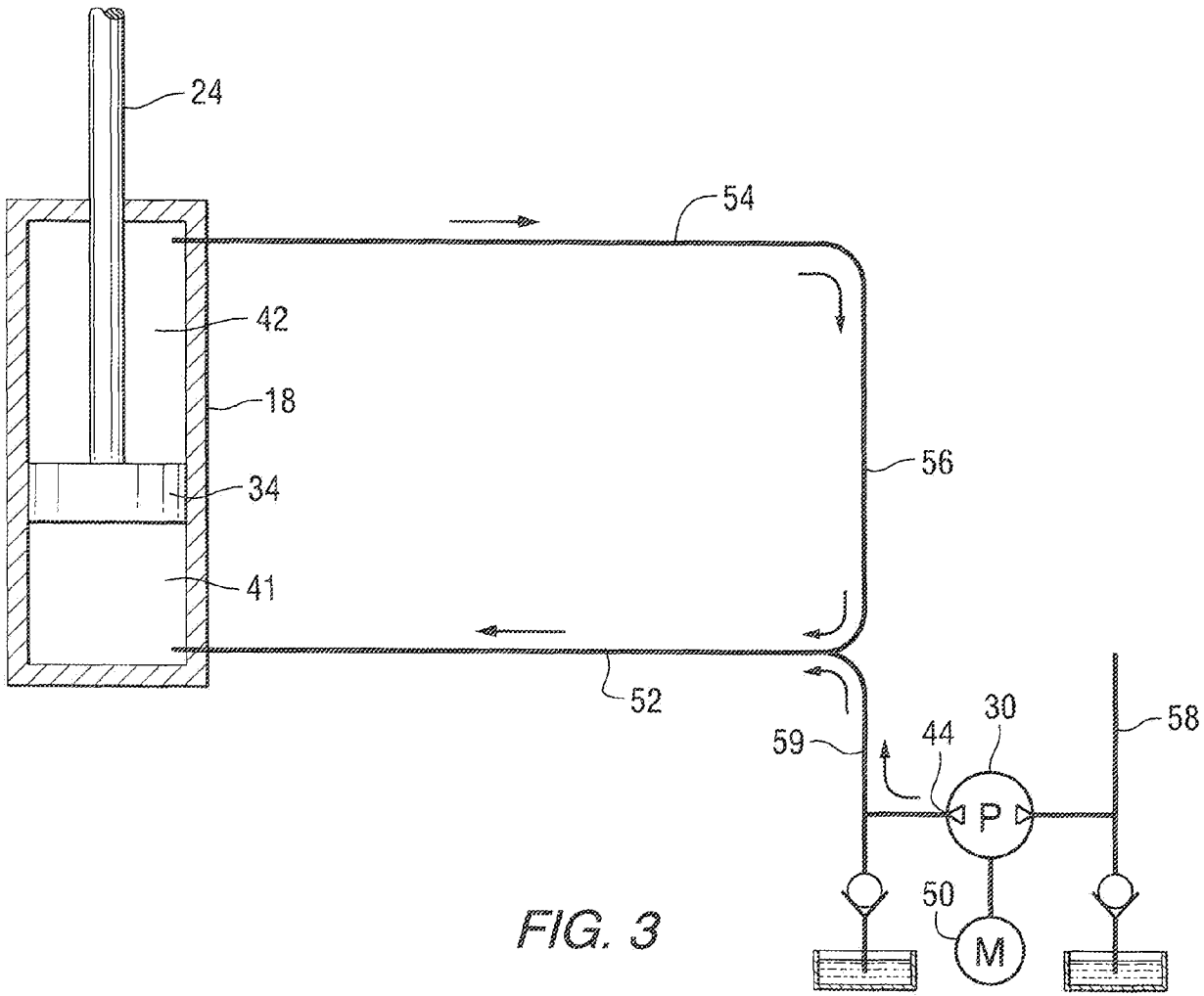
FIG. 3 shows a connection of conduits of the system of FIG. 2 which results in a fast mode of operation according to a preferred embodiment of the present invention.

FIG. 3 illustrates a hydraulic system which is operatively connected in a manner that differs from FIG. 2. Conduits 52 and 54 are connected directly to each other, by conduit 56. When arranged as shown in FIG. 3, oil can flow from the pump 30 as illustrated by the associated arrow, and flow into the first cavity 41 of the hydraulic cylinder 18. However, it can also be seen that oil flowing from the second cavity 42, through conduit 54 and conduit 56, can flow through conduit 52 to the first cavity 41 of the hydraulic cylinder 18. This flow of oil is in addition to the oil provided by the outlet 44 of the pump 30. The return line 58 is disconnected in the arrangement shown in FIG. 3. Therefore, as the pump 30 continues to run, the piston 34 moves upwardly within the cylinder 18 and oil flowing out of the second cavity 42 flow into the first cavity 41. Oil from both the second cavity 42 and the pump 30 flow into the first cavity 41. The arrangement shown in FIG. 3 results in the actuator shaft 24 moving at a rate which is greater than the rate at which it moves in a configuration such as that shown in FIG. 2.

With continued reference to FIG. 3, it can be seen that the effective volume of the second cavity 42 is less than the effective volume of the first cavity 41, because of the fact that the actuator shaft 24 displaces a certain amount of oil within the second cavity 42. Therefore, as the piston 34 moves upwardly in FIG. 3, more oil is conducted into the first cavity 41 than flows out of the second cavity 42. This amount of oil is made up by oil provided from the outlet 44 of the pump 30. As a result, with relatively little flow demand from the pump 30, the piston 34 and its actuator shaft 24 can move relatively quickly.

Figure 4:
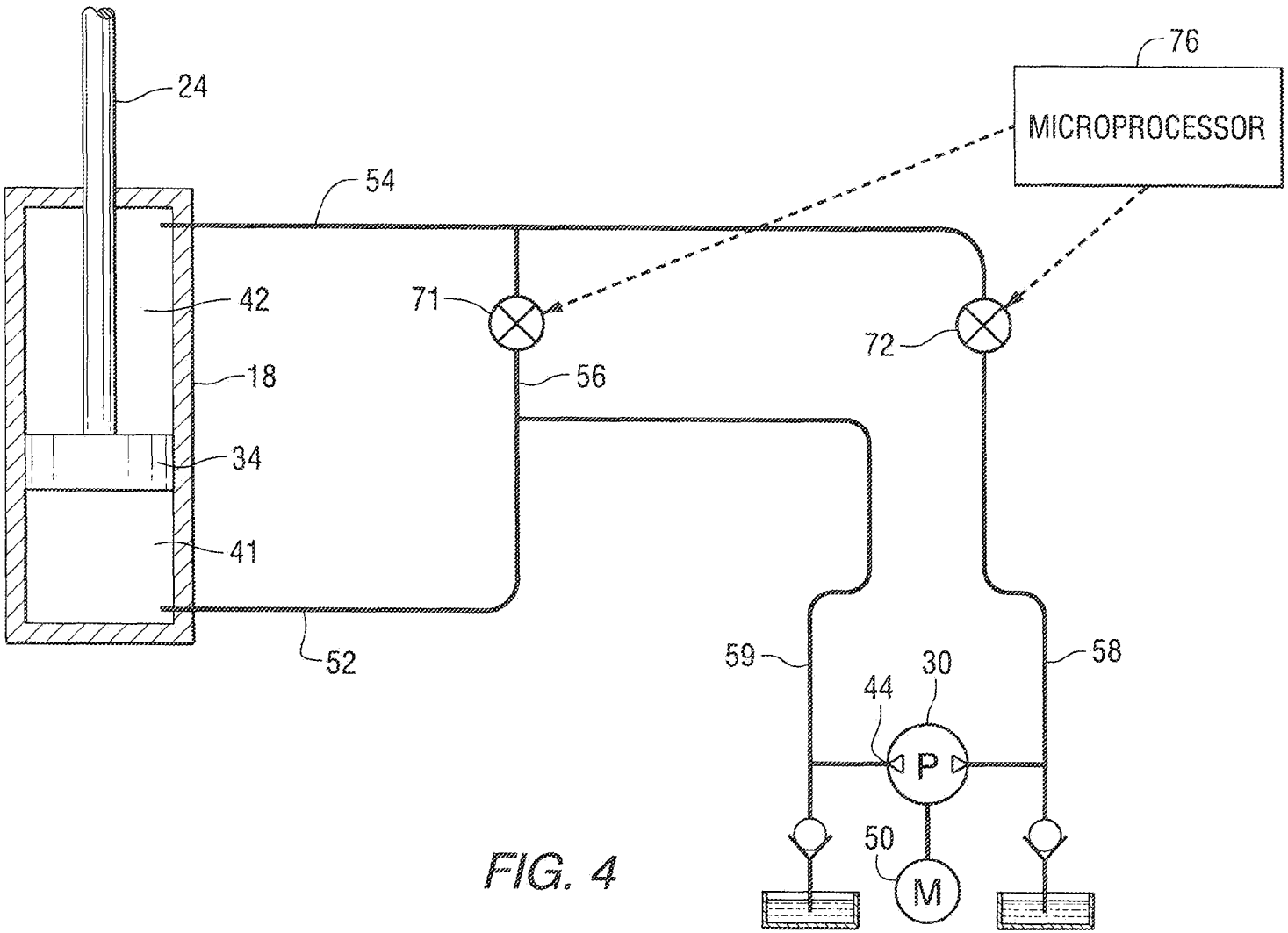
FIG. 4 illustrates an alternative embodiment of the present invention using two valves controlled by a microprocessor.

In order to change the hydraulic circuit from that shown in FIG. 2 to that arrangement shown in FIG. 3, various techniques can be implemented according to various embodiments of the present invention. FIG. 4 shows an arrangement that allows this change. For purposes of describing the different operational states of the hydraulic circuit, the operation will be described in terms of a first mode of operation and a second mode of operation. The first mode of operation is that which causes the piston 34 to move at a relatively slow rate. The second mode of operation causes piston 34 to move at a faster rate. The arrangement shown in FIG. 2 performs the movement of the piston 34 and actuator shaft 24 according to the first, or slower, mode of operation. The circuit shown in FIG. 3 moves the piston 34 at the faster speed of the second mode of operation.

FIG. 4 is a hydraulic arrangement that incorporates two computer controlled valves, 71 and 72. By opening valve 71, the microprocessor 76 can permit flow of hydraulic fluid between conduits 54 and 52. By closing valve 71, this flow of oil is inhibited. By closing valve 72, the microprocessor 76 can inhibit the flow of oil from the second cavity 42 to the return line 58 of the pump 30. By opening valve 72, the microprocessor 76 can permit this return flow of oil from the second cavity 42 to the return line 58 of the pump 30. The intended operation of valves 71 and 72 are such that when one of the valves is open the other is closed. The microprocessor 76 is configured to make a determination of whether the system is operated according to the first or second modes of operation. As an example, if a marine vessel is being operated at relatively high speed, any requested trim or tilt operation would require the first mode of operation which is relatively slow in comparison to the second mode of operation. However, at slow speeds which are less than a threshold maximum speed, the second mode of operation would typically be commanded by the microprocessor when a marine vessel is being operated at relatively slow speeds or, as described above, when the marine vessel is being prepared for transport on a trailer.

Figure 5:
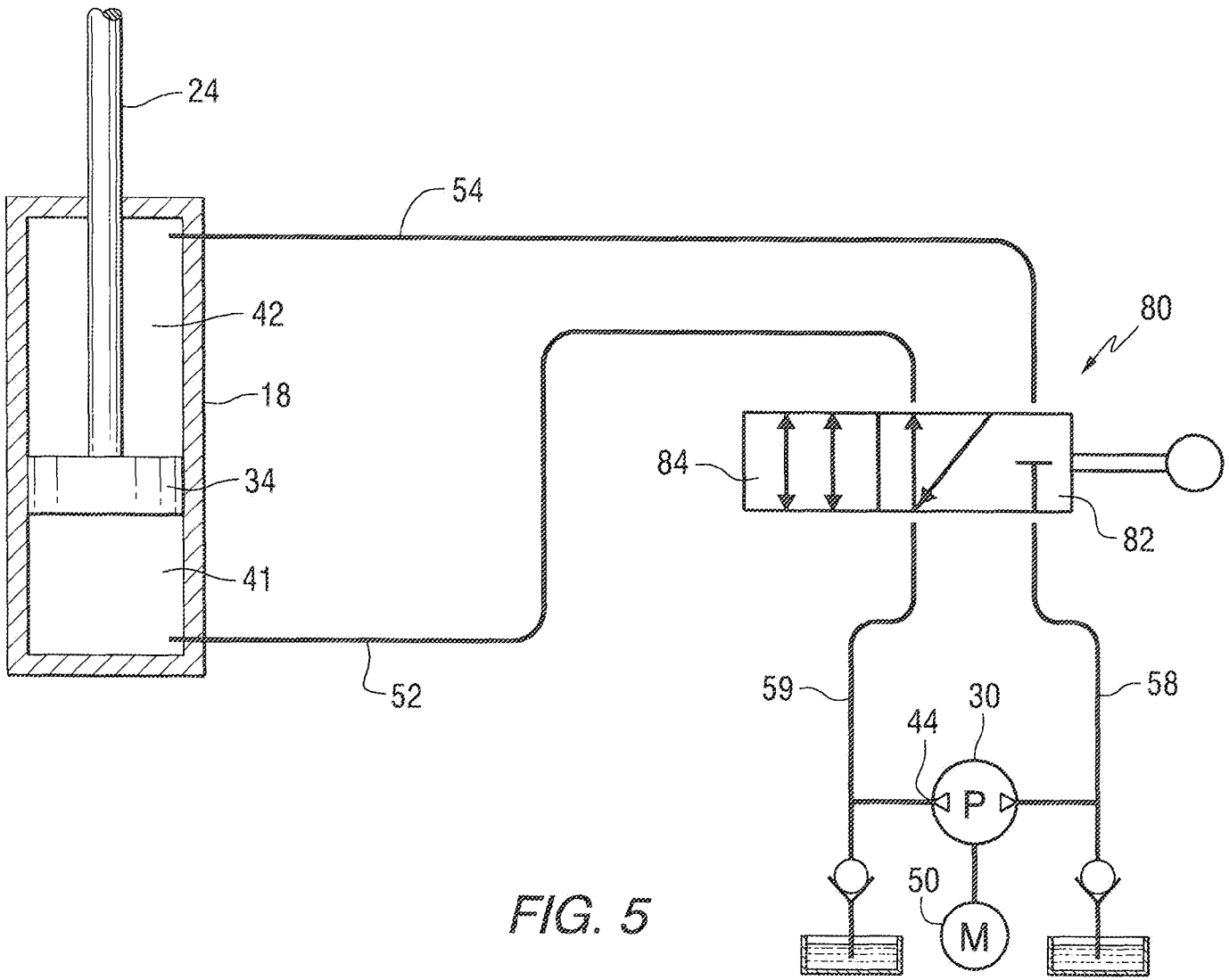
FIG. 5 shows an embodiment of the present invention which can use a valve, symbolically illustrated, that can be manually actuated.

FIG. 5 is a schematic representation of an alternative embodiment of the present invention in which a two-position valve 80 is used to change the configuration of conduits and affect the path of the oil between the pump 30 and the cylinder 18. When in the position shown in FIG. 5, the valve blocks the return line 58 and connects conduit 54 in fluid communication with conduit 52. In addition, as symbolically represented by the valve 80, the pressure outlet 44 of the pump 30 is connected to conduit 52. This arrangement results in the cylinder 18 operating in the second mode of operation which is faster, as described above, than the first mode of operation. If the valve 80 is moved to the right in FIG. 5, the return line 58 is connected directly to conduit 54 and the outlet 44 of the pump 30 is connected directly to conduit 52. This configuration causes the system to operate in the first mode, or slower mode, of operation. In addition, the reverse movement of the piston 34, to retract the actuator shaft 24, can be achieved by reversing the operation of the pump 30 so that pressurized oil flows through conduit 58, which also serves as a return line, and conduit 54. The oil would then return from the first cavity 41, through conduit 52, to the pump 30 through conduit 59.

With continued reference to FIG. 5, the two-position valve 80 can be mechanically operated by the operator of a marine vessel. This can be accomplished through the use of a lever or push button that is manually controlled. Alternatively, a speed sensing mechanism associated with the engine can be used to cause the system to operate either in the first mode of operation or the second mode of operation. The two-position valve 80 in FIG. 5 is further identified by reference numerals 82 and 84. Reference numeral 82 describes the portion of the valve 80 which is used to cause the system to operate in the second mode, or fast mode. Reference numeral 84 identifies the portion of the valve 80 that causes the system to operate in the first mode.

It is important to understand that the first and second modes of operation of the present invention are significantly different and result in a different speed of operation of the actuator shaft 24. With reference to FIG. 2, flow of oil from the pump 30 in the direction represented by the arrows causes the pressure in the first cavity 41 to be generally equal to the outlet pressure 44 of the pump 30. On the other hand, the pressure in the second cavity 42 is generally equal to the return line 58 pressure which is, essentially, at ambient pressure. This significant difference in pressure causes the piston 34 to move upwardly and actuate the actuator shaft 24. However, all of the fluid flowing into the first cavity 41 must come from the pump 30. The flow capacity of the pump 30 therefore limits the speed of operation of the actuator shaft 24. In comparison, FIG. 3 shows the system connected for operation in the second mode of operation. The pressures within the first cavity 41 and second cavity 42 are generally equal to each other and to the outlet pressure 44 of the pump 30. As a result, the force moving the piston 34 is equal to the pressure provided by the pump 30 multiplied by the differential area which can be determined by calculating the complete area of the piston 34, as viewed from the first cavity 41, and then subtracting the area determined as a differential between the total area of the piston 34 and the area of the cross-section of the actuator shaft 24. This results in an upward force on the piston 34 equal to the pressure of the pump 30 multiplied by the cross-sectional area of the actuator shaft 24. Comparing FIGS. 2 and 3, it can be seen that a significant benefit is provided by connecting the first and second cavities, 41 and 42, in fluid communication through the use of conduit 56. The oil flowing out of the second cavity 42 is able to flow into the first cavity 41. This flow of hydraulic oil need not be provided by the pump 30. The pump 30 provides a flow of pressurized oil through conduit 59 which is generally equal to the volume of the actuator shaft 24 that moves out of the cylinder 18 as the piston 34 moves upwardly.

It can be seen that the present invention provides a significant advantage with very little additional equipment needed. The output capacity of the pump 30 is aided by the flow of oil, through conduit 54, 56, and 52, from the second cavity 42 to the first cavity 41. This magnitude of oil need not be provided by the pump 30 when the system is operating in the second mode of operation.

With continued reference to FIGS. 1-5, it can be seen that the method for controlling a marine propulsion trim system, in accordance with a preferred embodiment of the present invention, comprises the steps of providing a pump 30, providing a hydraulic cylinder 18, providing a piston 34 which is disposed in the cylinder 18, wherein the piston 34 divides the internal volume of the cylinder 18 into first 41 and second 42 cavities, providing an actuator shaft 24 attached to the piston 34 and extending through the second cavity 42, connecting an outlet 44 of the pump 30 in fluid communication with the first cavity 41 (as provided by conduits 59 and 52), receiving a first signal which represents a change from a first mode of operation to a second mode of operation, and connecting the second cavity 42 in fluid communication with the first cavity 41 in response to the first signal. The first signal can be provided mechanically by the operator of the marine vessel or electronically. In the embodiment shown in FIG. 4, a microprocessor 76 provides the signal based on a determination relating to the current use of the marine vessel. In other words, if the marine vessel is being operated above a predetermined operating speed, the system will be caused to operate in the first mode of operation. That results in a slower actuation of the actuator shaft 24. However, under other circumstances where the marine vessel is operating at speeds below the threshold, the actuator 24 is operated at the faster speed that results during the second mode of operation.

Although the present invention has been described with particular specificity and illustrated to show several embodiments, it should be understood that alternative embodiments are also within its scope.

I claim:

1. A method for controlling a marine propulsion trim system, comprising:

providing a pump;

providing a hydraulic cylinder;

providing a piston disposed within said cylinder, said piston dividing an internal volume of said cylinder into first and second cavities;

providing an actuator shaft attached to said piston and extending through said second cavity;

connecting an outlet of said pump in fluid communication with said first cavity;

receiving a first signal which represents a change from a first mode of operation providing a first speed of movement of said actuator shaft to a second mode of operation providing a second, faster speed of movement of said actuator shaft in a same direction as said first speed of movement of said actuator shaft; and connecting said second cavity in fluid communication with said first cavity in response to said first signal.

2. The method of claim 1, further comprising:

receiving a second signal which represents a change from said second mode of operation to said first mode of operation; and connecting said second cavity in fluid communication with a return line to said pump.

3. The method of claim 2, further comprising:

disconnecting said second cavity from said return line to said pump in response to said first signal which represents a change from a first mode of operation to a second mode of operation.

4. The method of claim 1, wherein:

said pump is a fixed displacement pump.

5. The method of claim 1, wherein:

said first cavity receives oil from said second cavity and from said pump when said marine propulsion trim system is in said second mode of operation.

6. The method of claim 1, further comprising:

connecting said cylinder between a transom of a marine vessel and an outboard motor.

7. A method for controlling a marine propulsion trim system, comprising:

providing a pump;

providing a hydraulic cylinder;

providing a piston disposed within said cylinder, said piston dividing an internal volume of said cylinder into first and second cavities;

providing an actuator shaft attached to said piston and extending through said second cavity;

connecting a first conduit in fluid communication between an outlet of said pump and said first cavity;

connecting a second conduit in fluid communication between said second cavity and an oil return line to said pump;

connecting a third conduit in fluid communication between said first and second cavities;

receiving a first signal which represents a change from a first mode of operation providing a first speed of movement of said actuator shaft to a second mode of operation providing a second, faster speed of movement of said actuator shaft in a same direction as said first speed of movement of said actuator shaft;

inhibiting flow through said second conduit in response to said first signal; and permitting a flow through said third conduit in response to said first signal.

8. The method of claim 7, further comprising:

receiving a second signal which represents a change from said second mode of operation to said first mode of operation;

inhibiting flow through said third conduit in response to said second signal; and permitting a flow through said second conduit in response to said second signal.

9. The method of claim 8, wherein:

oil flows from said second cavity and from said pump into said first cavity when said marine propulsion trim system is in said second mode of operation.

10. The method of claim 7, wherein:

said pump is a fixed displacement pump.

11. The method of claim 7, further comprising:

connecting said cylinder between a transom of a marine vessel and an outboard motor.

12. A method for controlling a marine propulsion trim system, comprising:

providing a pump;

providing a hydraulic cylinder;

providing a piston disposed within said cylinder, said piston dividing an internal volume of said cylinder into first and second cavities;

providing an actuator shaft attached to said piston and extending through said second cavity;

connecting a first conduit in fluid communication between an outlet of said pump and said first cavity;

connecting a second conduit in fluid communication between said second cavity and an oil return line to said pump;

connecting a third conduit in fluid communication between said first and second cavities;

inhibiting flow through said third conduit when said marine propulsion trim system is in a first mode of operation providing a first speed of movement of said actuator shaft;

permitting a flow through said second conduit when said marine propulsion trim system is in said first mode of operation;

inhibiting flow through said second conduit when said marine propulsion trim system is in a second mode of operation providing a second, faster speed of movement of said actuator shaft in a same direction as said first speed of movement of said actuator shaft; and permitting a flow through said third conduit when said marine propulsion trim system is in said second mode of operation.

13. The method of claim 12, further comprising:

receiving a first signal which represents a change from said first mode of operation to said second mode of operation.

14. The method of claim 13, further comprising:

receiving a second signal which represents a change from said second mode of operation to said first mode of operation.

15. The method of claim 12, wherein:

oil flows from said second cavity and from said pump into said first cavity when said marine propulsion trim system is in said second mode of operation.

16. The method of claim 12, wherein:

said pump is a fixed displacement pump.

17. The method of claim 12, further comprising:

connecting said cylinder between a transom of a marine vessel and an outboard motor.

* * * * *